US007048827B2

(12) United States Patent
Watson et al.

(10) Patent No.: US 7,048,827 B2
(45) Date of Patent: May 23, 2006

(54) DYNAMIC CALIBRATION OF PAPERMAKING MACHINE

(75) Inventors: John David Watson, Toronto (CA); Claud Hagart Alexander, Redwood City, CA (US)

(73) Assignee: Honeywell International Inc., Morristown, NJ (US)

( * ) Notice: Subject to any disclaimer, the term of this patent is extended or adjusted under 35 U.S.C. 154(b) by 49 days.

(21) Appl. No.: 10/854,053

(22) Filed: May 26, 2004

(65) Prior Publication Data

US 2005/0274473 A1 Dec. 15, 2005

(51) Int. Cl.
*D21F 7/06* (2006.01)

(52) U.S. Cl. ..... 162/198; 162/252; 162/253; 162/262; 162/263; 162/DIG. 6; 162/DIG. 11; 700/128; 324/694; 324/695

(58) Field of Classification Search ..... 162/198, 162/252–254, 258–263, DIG. 10, DIG. 11; 700/127–129; 324/691, 693–696
See application file for complete search history.

(56) References Cited

U.S. PATENT DOCUMENTS 3,655,980 A * 4/1972 Bossen ..... 378/54
5,853,543 A 12/1998 Hu et al. ..... 162/198
5,872,454 A 2/1999 West ..... 324/439
5,891,306 A 4/1999 Chase et al. ..... 162/198
5,892,679 A 4/1999 He ..... 364/149
5,954,923 A 9/1999 Chase et al. ..... 162/263
6,059,931 A 5/2000 Hu et al. ..... 162/198
6,076,022 A * 6/2000 Hagart-Alexander et al. ..... 700/127
6,080,278 A 6/2000 Heaven et al. ..... 162/198
6,086,716 A * 7/2000 Watson et al. ..... 162/198
6,092,003 A 7/2000 Hagart-Alexander et al. ..... 700/129
6,149,770 A 11/2000 Hu et al. ..... 162/199
6,281,689 B1 8/2001 Chase et al. ..... 324/691
6,466,839 B1 10/2002 Heaven et al. ..... 700/128

* cited by examiner

*Primary Examiner*—Eric Hug
(74) *Attorney, Agent, or Firm*—Charles Jew, Jr.

(57) ABSTRACT

Sheetmaking processes such as papermaking making systems employ water weight sensors underneath the moving water permeable wire that supports the wet stock (pulp slurry). A dynamically compensated calibration equation that equates the water weight plus fiber weight plus wire weight (total weight) to the resistance measured by the water weight sensor is developed for controlling the continuous process. Dynamic compensation accounts for changing papermaking machine conditions or states that affect the intrinsic conductivity of the wet stock being measured. The amount of correction to apply is determined by the conductance measured by a reference sensor.

20 Claims, 11 Drawing Sheets

DYNAMIC CALIBRATION OF PAPERMAKING MACHINE

FIELD OF THE INVENTION

The present invention generally relates to controlling continuous sheetmaking and, more specifically, to dynamically calibrating water weight sensors used to measure the water weight of paper stock on the fourdriner wire of a papermaking machine.

BACKGROUND OF THE INVENTION

In the art of making paper with modern high-speed machines, sheet properties must be continually monitored and controlled to assure sheet quality and to minimize the amount of finished product that is rejected when there is an upset in the manufacturing process. The sheet variables that are most often measured include basis weight, moisture content, and caliper, i.e., thickness, of the sheets at various stages in the manufacturing process. These process variables are typically controlled by, for example, adjusting the feedstock supply rate at the beginning of the process, regulating the amount of steam applied to the paper near the middle of the process, or varying the nip pressure between calendaring rollers at the end of the process. Papermaking devices are well known in the art and are described, for example, in *Handbook for Pulp & Paper Technologists* 2nd ed., G. A. Smook, 1992, Angus Wilde Publications, Inc., and *Pulp and Paper Manufacture* Vol III (Papermaking and Paperboard Making), R. MacDonald, ed. 1970, McGraw Hill. Sheetmaking systems are further described, for example, in U.S. Pat. No. 5,539,634 to He, U.S. Pat. No. 5,022,966 to Hu, U.S. Pat. No. 4,982,334 to Balakrishnan, U.S. Pat. No. 4,786,817 to Boissevain et al., and U.S. Pat. No. 4,767,935 to Anderson et al.

In the manufacture of paper on continuous papermaking machines, a web of paper is formed from an aqueous suspension of fibers (stock) on a traveling mesh papermaking fabric and water drains by gravity and vacuum suction through the fabric. The web is then transferred to the pressing section where more water is removed by dry felt and pressure. The web next enters the dryer section where steam heated dryers and hot air completes the drying process. The papermaking machine is essentially a de-watering system. In the sheetmaking art, the term machine direction (MD) refers to the direction that the sheet material travels during the manufacturing process, while the term cross direction (CD) refers to the direction across the width of the sheet which is perpendicular to the machine direction.

U.S. Pat. No. 5,891,306 to Chase et al. describes a sensor that measures water weight on the wire of a papermaking machine. The sensor detects changes in resistance of the wet stock between the electrodes in an electrode array. The resistance of the wet stock between the electrodes is dependent on the amount of water above the electrodes, i.e., the water weight, and on the conductivity of the water. Since the conductivity of the water changes from time to time, the resistance measurement does not uniquely determine the amount of water unless some correction for the conductivity is provided. Consequently, the sensor also includes a separate reference cell which is designed to cancel out all affects that change the resistance between the electrodes other than the water weight. For instance, the resistance measurement is affected by changes in conductivity due to changes in the wet stock temperature or chemical composition.

SUMMARY OF THE INVENTION

The present invention is based in part on the development of a dynamically compensated calibration equation that equates the water weight plus fiber weight plus wire weight (total weight) to the resistance measured by the above described water weight sensor. Dynamic compensation is required to account for changing papermaking machine conditions or states that affect the intrinsic conductivity of the wet stock, i.e., pulp slurry, being measured. The amount of correction to apply is determined by the conductance measured by the reference sensor.

In one aspect, the invention is directed to a method of monitoring the formation of a sheet of wet stock comprising fibers wherein the wet stock is formed on a water permeable movable wire of a de-watering machine that has a headbox with a plurality of apertures through which wet stock is introduced onto the wire at a controlled flow rate, said method includes the steps of:

(a) positioning three or more water weight sensors (measurement sensors) underneath and adjacent to the wire and upstream from a dry line which develops during operation of the machine wherein all the measurement sensors have substantially the same configuration;

(b) positioning a reference sensor so that it will measure the wet stock under saturated conditions;

(c) calibrating the measurement sensors to equate conductance measurements made by the three or more water weight sensors to water weight (or value) above the three or more water weight sensors to develop a calibration equation, and, following step (c);

(d) measuring the conductance of the wet stock with one or more of the measurement sensors and using the calibration equation to provide the absolute water weight(s) in substantially real time.

In another aspect, the invention is directed to a system of controlling the formation of wet stock which comprises fibers on a moving water permeable wire of a de-watering machine that includes:

wet-dry devices that comprises (i) means for supplying an amount of pulp from at least one source, (ii) means for adding an amount of non-fibrous additives to the wet stock, (iii) a refiner that subjects the fibers to mechanical action, said refiner having a motor load controller, and (iv) a headbox having at least one slice wherein each slice has an aperture through which wet stock is discharged at a certain stock jet speed onto the wire that is moving at a certain wire speed, and dry-end devices that dry a sheet of material from the wire, which system includes:

(a) at least one water weight measurement sensor that is positioned adjacent to the wire and upstream from a dry line which develops during operation of the machine;

(b) a reference sensor that measures the water weight of the wet stock under saturated conditions, wherein the measurement sensor has been calibrated in accordance with procedures (a), (b), and (c) of the inventive method; and (c) means for adjusting at least one of the wet-end or dry-end devices in response to water weight measurements.

DETAILED DESCRIPTION OF PREFERRED EMBODIMENTS

The present invention generally relates to devices for detecting properties of an aqueous mixture, e.g., wet stock, on a de-watering machine wherein the devices exhibit enhanced precision and sensitivity over a wide range of mixture concentrations. Measurements from the devices for instance can be employed for process control in papermaking machines.

The invention is based in part on the development of calibration techniques that can be employed with any water weight sensing device that measures the amount of a liquid product by detecting its conductance/resistance. Particularly preferred sensing devices have sensors or electrodes that are positioned below the liquid product to be measured with the electrodes facing the liquid product. The sensing device has an effective range whereby conductance/resistance measurements correlate to the amount of liquid product present, resting on the electrodes.

Papermaking Machine

Figure 1A:
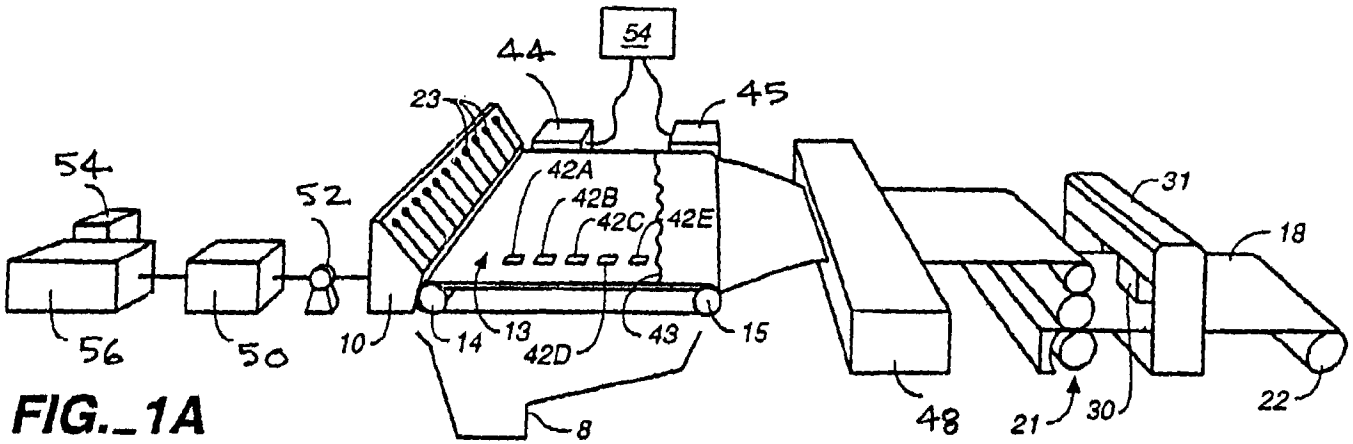
FIG. 1A shows a sheetmaking system implementing the technique of the present invention.

FIG. 1A shows a system for producing continuous sheet material that comprises a headbox 10, a calendaring stack 21, and reel a 22. The papermaking raw material is metered, diluted, mixed with any necessary additives, and finally screened and cleaned as it is introduced into the headbox 10 from a source 50 by a fan or feeding pump 52. This pump mixes stock with the white water and delivers the blend to the headbox 10.

The process of preparing the wet stock includes the step of subjecting the fibers to mechanical action in the refiner 56 which includes a variable motor load controller 54. By regulating the refiner one can, among other things, regulate strength development and stock drainability and sheet formation. Many variables affect the refining process and these generally include, for example, the characteristics of the raw materials, e.g., fiber morphology, equipment characteristics, and the pH.

The actuators 23 in the headbox 10 discharge raw material through a plurality of slices onto supporting web or wire 13 which rotates between the rollers 14 and 15 which are driven by motors 44 and 45, respectively. Controller 54 regulates the speed of the motors. Foils and vacuum boxes (not shown) drain liquid, commonly known as "white water," from the wet stock on the wire into the wire pit 8 for recycle. Sheet material exiting the wire passes through a dryer 24. A scanning sensor 30, which is supported on the supporting frame 31, continuously traverses the sheet and measures properties of the finished sheet in the cross-direction. Multiple stationary sensors could also be used. Scanning sensors are known in the art and are described, for example, in U.S. Pat. No. 5,094,535 to Dalquist et al., U.S. Pat. No. 4,879,471 to Dalquist, U.S. Pat. No. 5,315,124 to Goss et al., and U.S. Pat. No. 5,432,353 to Goss et al., which are incorporated herein. The finished sheet product 18 is then collected on reel 22. As used herein, the "wet end" portion of the system depicted in FIG. 1A includes the headbox, the web, and those sections just before the dryer, and the "dry end" comprises the sections that are downstream from the dryer.

In operation of the papermaking machine, one or more water weight sensors can be positioned underneath the wire 13. CD and/or MD arrays of such sensors can also be employed. Signals from the sensors can be used for process control as further described herein. In the embodiment as shown in FIG. 1A, an MD array, that includes five measurement water weight sensors 42A–42E, is positioned underneath the web 13. By this meant that each sensor is positioned below a portion of the web that supports the wet stock. The sensors are positioned upstream from the dry line 43. As further described herein, each sensor is configured to measure the water weight of the sheet material as it passes over the sensor. The sensor provides continuous measurement of the sheet material along the machine direction (MD) at the points where it passes each sensor.

Production mode of operation of the papermaking machine should be distinguished from calibration mode of operation. The latter requires an MD array with a minimum of three sensors as described herein; preferably four to six sensors are employed and preferably the sensors are positioned in tandem in the MD about 1 meter from the edge of the wire. Preferably, the individual sensors are about 30 to 60 cm apart. For practical purposes, the same MD arrangement with 3 or more sensors can be used for both calibration and production operations.

The term "water weight" refers to the mass or weight of water per unit area of the wet or paper stock that is on the web. Typically, the water weight sensors are calibrated to provide engineering units of grams per square meter (gsm). As an approximation, a reading of 10,000 gsm corresponds to paper stock having a thickness of 1 cm on the wire. The term "basis weight" refers to the total weight of the material per unit area. The term "dry weight" or "dry stock weight" refers to the weight of a material (excluding any weight due to water) per unit area.

It has been demonstrated that fast variations of water weight on the wire correlate well to fast variations in dry basis weight of the sheet material produced when the water weight is measured upstream from dry line 43 on the wire. The reason is that essentially all of the water on the wire is being held by the paper fibers. Since more fibers hold more water, the measured water weight correlates well to the fiber weight.

Figure 1B:
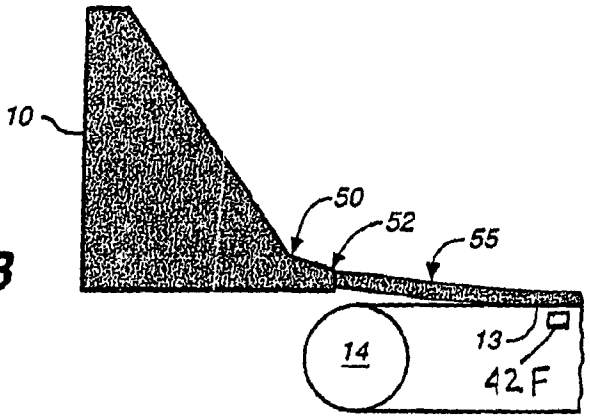
FIG. 1B shows the relationship of the slices in the headbox and wire and their proximity to the reference water weight sensor.

FIG. 1B illustrates a headbox 10 having a plurality of slices or apertures 50 which discharge wet stock 55 onto wire 13. For a headbox that is 300 inches (7.62 m) in length, there can be 100 or more slices. The rate at which wet stock is discharged through the nozzle 52 of the slice can be controlled by a corresponding actuator which, for example, regulates the diameter of the nozzle. The function of the headbox is to take the stock that is delivered by the fan pump and transform a pipeline flow into an even, rectangular discharge equal in width to the paper machine and at uniform velocity in the machine direction. A reference water weight sensor 42F is positioned underneath web 13 and adjacent to aperture 50. The reference sensor preferably has substantially the same structure and configuration as that of the measurement water weight sensors.

Dynamic Calibration

Embodiments of the present invention provide methods of calibrating water weight sensors that are employed in a papermaking machine. The methods yield mathematical relationships that correlate conductance measurements of the wet stock generated by the sensors positioned underneath the wire to corresponding water weights. Essentially real time data from the sensors are measured and manipulated accordingly.

For calibration, three or more and preferably four to six measurement sensors arranged in an MD array are employed. Preferably, the measurement sensors all have substantially the same configuration. The reference sensor may have substantially the same configuration as the measurement sensors.

Two related calibration techniques are presented; both techniques rely on conductance measurements from a papermaking machine operating in the calibration mode while making different grades of paper to generate data for deriving the mathematical relationship. While the techniques are applicable to any de-watering machine that employs a moving, porous conveyer on which an aqueous mixture is transported, the techniques have been demonstrated on papermaking machines similar to that shown in FIGS. 1A and 1B.

The first technique is based on the discovery that, within certain operating parameters, there exists a linear relationship between the total water weight height on the wire for the paper stock and the inverse of the measured sensor signal resistance. Furthermore, it was observed that this relationship remains linear regardless of the grade of wet stock. Indeed, a series of substantially parallel calibration lines were obtained from data generated when the papermaking machine was operated in the calibration mode using different grades of paper stocks. (These different grades of paper stocks exhibit different conductances and are used to make different grades of paper in the production mode.) The second technique is an improvement of the first and in essence is an extension of the characterization of the sensor behavior over a larger range of paper stock conductances and a wider range of water weights.

The calibration equations that are derived provide absolute water weight measurements based on conductance measurements from water weight sensors. An absolute measurement of water weight is used to accurately monitor any changes in drainage on the wire which can affect the quality of paper produced.

Method 1. The first on-line calibration technique has been demonstrated to be particularly suited for measuring paper stock with water weights that range from about 2250 g/m$^2$ to 8500 g/m$^2$. In this realm, the dynamically compensated calibration is based on the following calibration equation (Equation 1):

$$\text{water weight}=S_{ref}*(G+\Delta G_{ref})+I_{ref} \quad (1)$$

where: $S_{ref}$ is the slope of the reference state calibration curve;

$I_{ref}$ is the y-intercept (value of the water weight at zero conductance) of the reference state calibration curve;

G=1/R is the reciprocal of the water weight sensor resistance reading, i.e., the conductance reading; and $\Delta G_{ref}=1/R_{ref}-1/R$, is the correction that refers the measured G values at any state back to the reference state.

Figure 6:
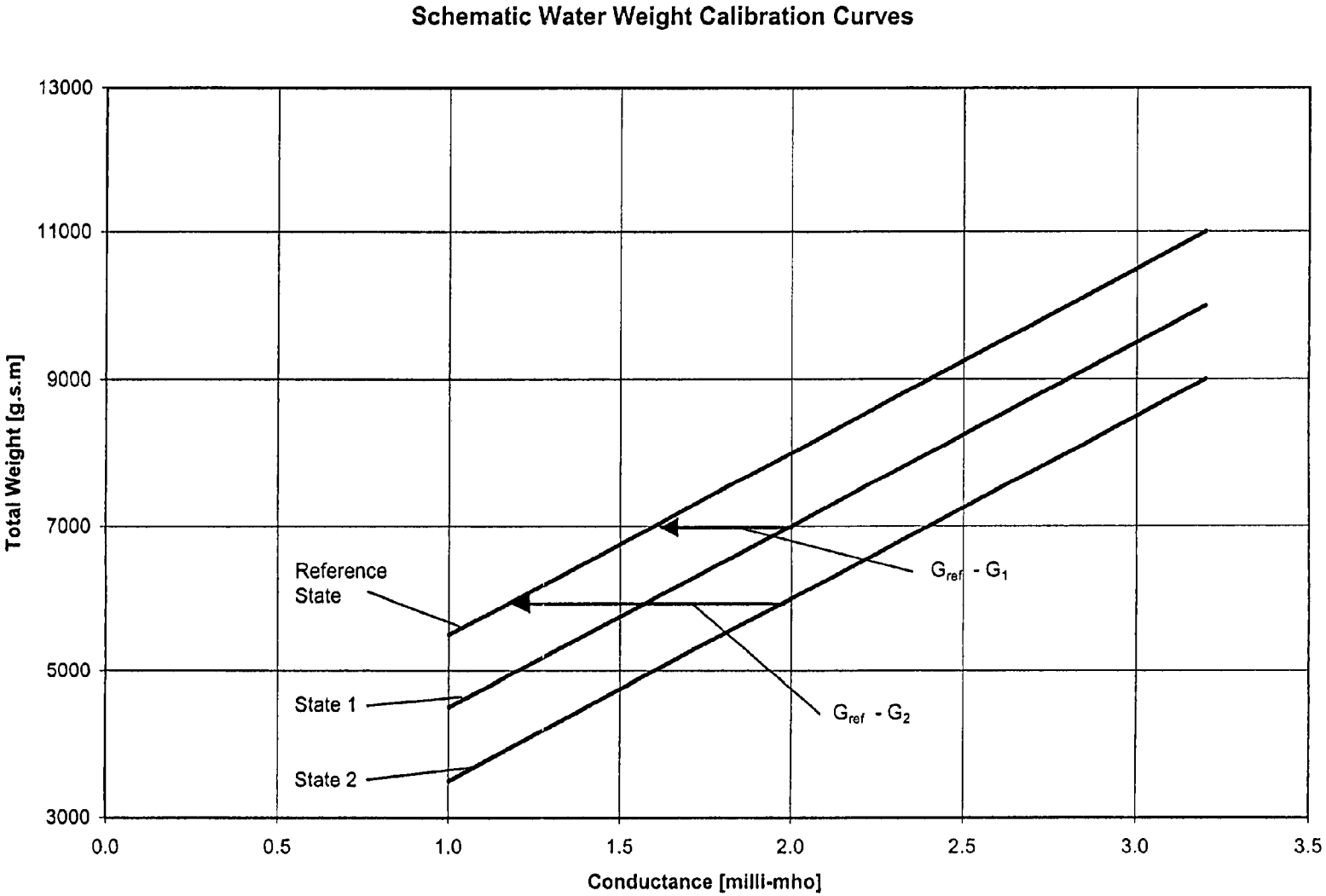
FIG. 6 is a schematic graph of the uncorrected conductance measurements vs. total water weight indicating how the correction for state is obtained.

$\Delta G_{ref}$ is the difference between G that is measured at any particular state and G that is measured at the reference state ($G_{ref}$–G in FIG. 6). This accounts for the conductance contribution from changes in the state of the paper stock (Paper stock is also referred as the "solution" herein).

The values of the parameters of the calibration equation are derived by the following steps 1–4:

(1) Referring o the papermaking machine shown in FIG. 1A, an array MD sensors under the wire, e.g., 42A to 42E, are employed to obtain uncompensated conductance readings during calibration mode operation of the papermaking machine under different operating conditions. As the uncompensated readings are made, the actual total water weights over the measurement water weight sensors, which comprise the weight of the wet stock and wire, are also measured with a gauge that measures the height of the paper stock above each sensor. In principle, two sets of measurements taken under two different operation conditions of the papermaking machine will suffice. In practice measurements from more than two are desirable for increased accuracy.

Figure 5:
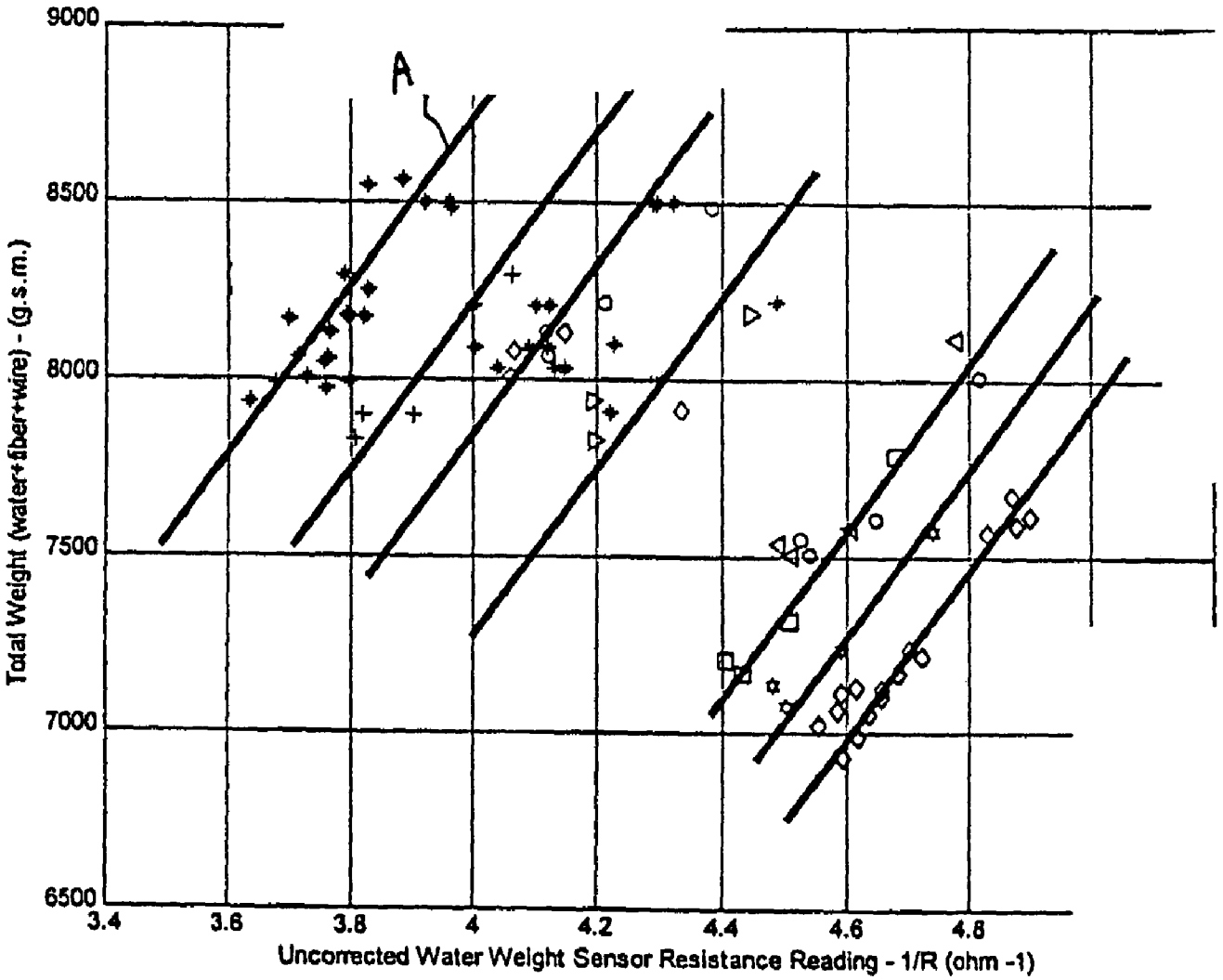
FIG. 5 is a graph of the uncorrected conductance measurements vs. total water weight.

FIG. 5 is a graph of the conductance versus total weight that shows the results of 22 measurement water weight sensor readings under the 7 sets of operating conditions. Each of the 22 reading is from one of the measurement MD water weight sensors. The conductance readings are uncompensated for the state of the paper stock and are divided into 7 groups, i.e., operating conditions, each with its own curve, i.e., line that is generated by conventional curve fitting techniques. These curves cover a sufficiently narrow range of operating conditions and therefore the slopes of the curves are essentially the same.

(2) While the papermaking machine is operating under each of the 7 different operating conditions in step (1), the corresponding saturated water weight conductance is measured with the reference sensor 42F that is positioned near the headbox as illustrated in FIG. 1B.

(3) Setting the first calibration group (curve A of FIG. 5) as a reference state calibration curve, the other 6 calibration curves are shifted to the left and converged into the reference state curve by applying a correction factor. This shifting process is illustrated in FIG. 6 which is graph of conductance vs. total weight measured under three operating conditions. One curve is selected as the reference state and two correction factors, i.e., $G_{ref}-G_1$ and $G_{ref}-G_2$, are shown.

Any of the 7 curves in FIG. 5 could have been selected as the reference state calibration curve since the selection of the reference state is arbitrary. As an example, to shift the individual readings of another curve (referred to as curve B) into curve A, the correction factor applied is proportional to the difference in the saturation water weight conductances as measured for curves A and B ($G_A-G_B$). Each shift for the remaining 5 other curves requires a different correction factor.

Figure 7:
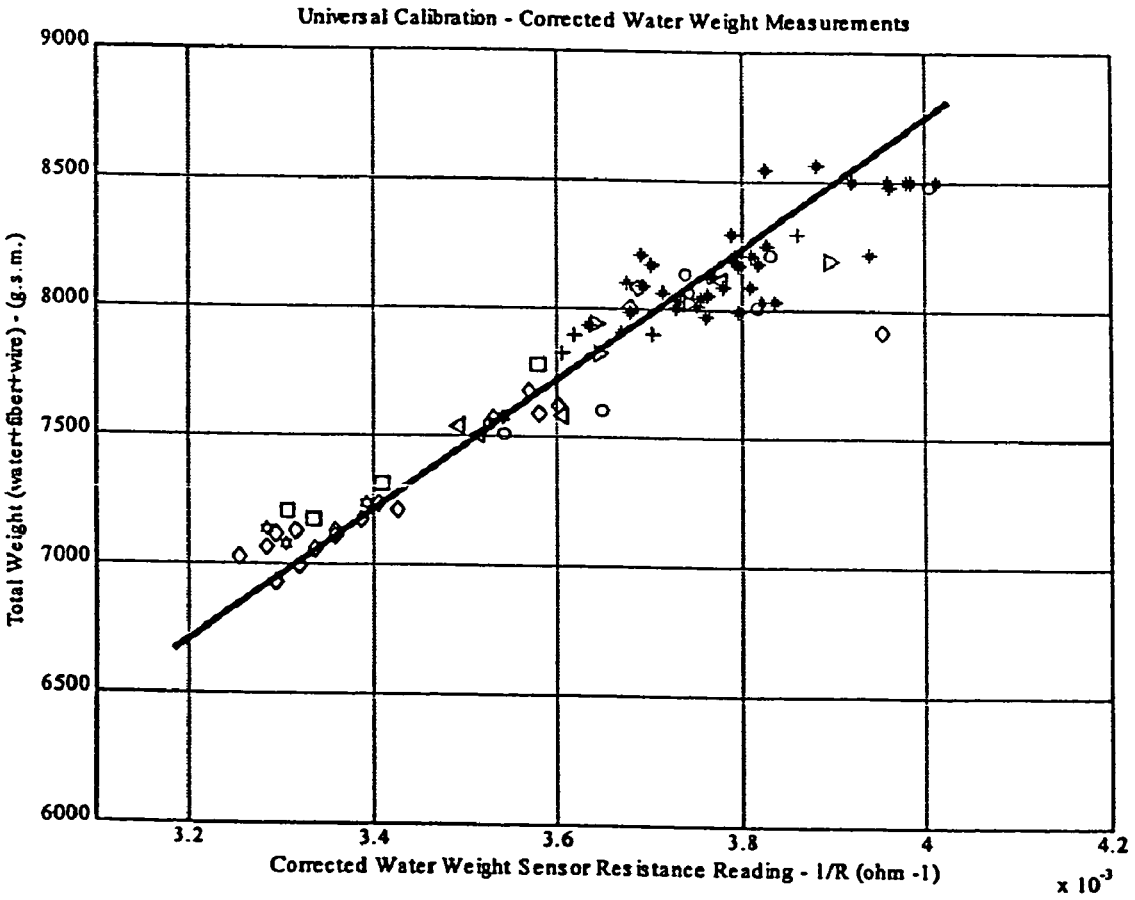
FIG. 7 is a graph of the corrected conductance measurements vs. total water weight.

Once all the readings have been shifted, a reference state calibration curve is created by curve fitting all 22 readings as shown in FIG. 7. As is apparent, the calibration curve of FIG. 7 is similar but not necessarily identical to curve A of FIG. 5. This calibration curve will be employed to continuously calculate water weight measurements during operations based on measurement readings and the corresponding reference sensor readings. Specifically, the reference state calibration curve provides the values for (i) $S_{ref}$ which is the slope of the curve, (ii) $I_{ref}$ which is the y-intercept (value of water weight at zero conductance) of the calibration. The only remaining variable for the calibration equation (1) is the correction factor $\Delta G_{ref}$.

(4) The value of the correction factor ($\Delta G_{ref}$) is calculated from the conductance measurement of any saturated reference sensor, i.e., any water weight sensor with a saturated signal. Saturated measurement conditions are achieved when any water weight sensor reading is unaffected by any further increases in water weight. Under these saturated conditions, this water weight sensor effectively measures changes in intrinsic bulk conductivity only. The correction factor is calculated using the deviation from the reference state conductance of the reference sensor. The relationship of the correction factor is defined in the following Equation 2:

$$\Delta G_{ref}=(G_{Sref}-G_S)/B \tag{2}$$

where:

$G_{Sref}$ is the conductance of the reference sensor at the reference state, i.e., for the selected reference state calibration curve;

$G_S$ is the conductance of the saturated water weight sensor at the measured state; and B is a factor that relates the shift in the calibration curve to the corresponding shift in the saturated reference sensor conductance due to a change in the solution state.

The "B" factor is calculated by correlating the shift that was applied to the 6 state dependent calibration curves as each was converged onto the reference state calibration curve to the corresponding shift in the reference sensor conductance from its reference state value. For example, referring to FIG. 6, each data point of the state 1 curve was shifted by a value of $G_{ref}-G_1$ and each data point of the state 2 curve was shifted by a value of $G_{ref}-G_2$ to the left to converged into the reference state calibration curve. The corresponding difference between the reference water weight sensor conductances for the reference state and the state 1 and state 2 curves were also calculated.

Figure 8:
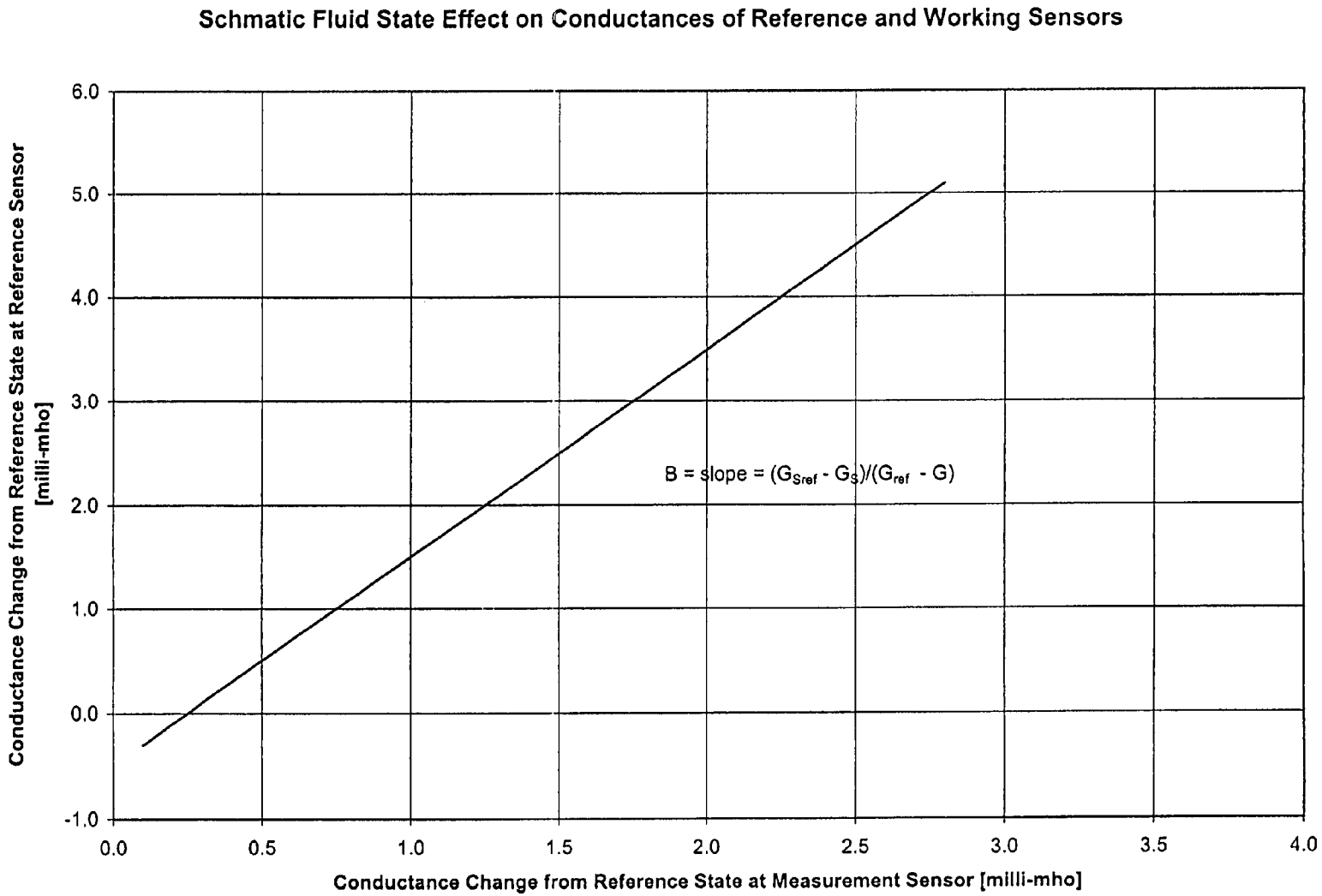
FIG. 8 is a schematic graph of the reference sensor conductance difference from reference state conductance vs. calibration curve difference from reference state calibration curve and illustrates how the parameter used in dynamically calculating the correction factor is obtained.

FIG. 8 is a schematic graph plotting the shift (amount of correction) for data points of a curve versus the corresponding difference between the reference sensor conductances. The slope of this graph is equal to the "B" factor in Equation 2. As is apparent, the "B" factor is a constant that relates the difference between a particular measured conductance and the reference conductance at the reference sensor to the shift of the calibration curve. The "B" factor is determined empirically for each papermaking machine calibration under different operation conditions, since it will vary with machine condition, reference and measurement sensor locations, and reference sensor geometry.

In practice, after the calibration curve is established, the "B" factor is calculated and the calibration equation can be employed thereafter to provide continuous corrected water weight readings from the measurement water weight sensors. The water weight can be determined from the total weight measured by subtracting the contribution of the wire that is fairly constant.

Figure 9:
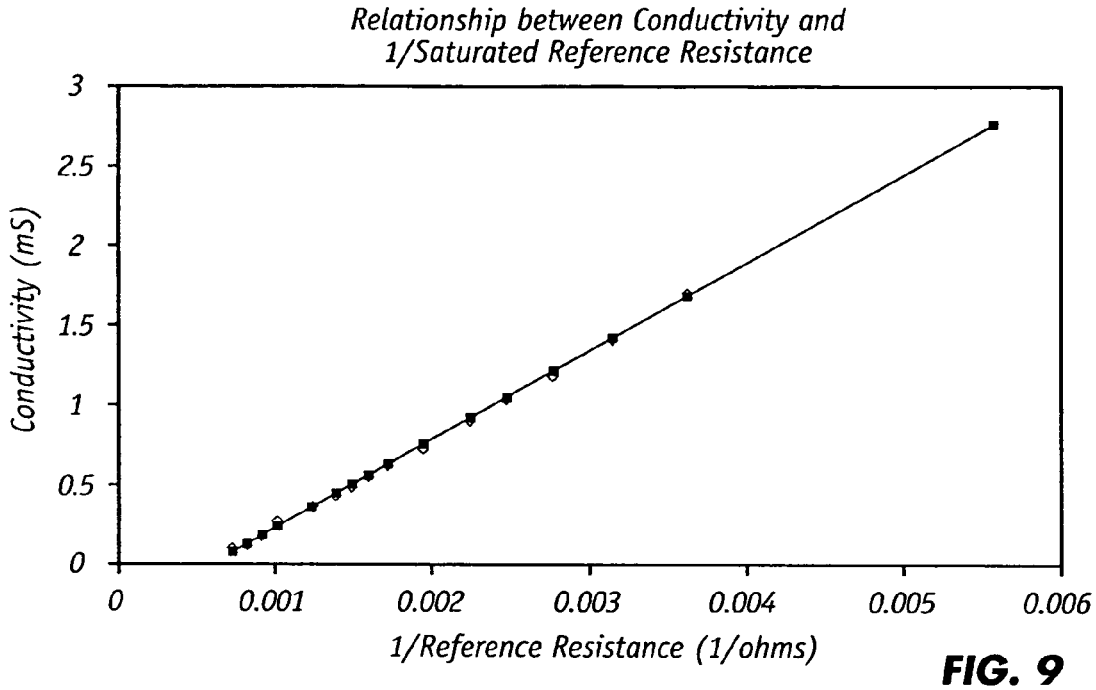
FIG. 9 is a graph of the conductivity vs. 1/(saturated reference resistance)

Method 2. The following improved dynamically compensated calibration can be applied for measuring paper stock(s) having a total water weight ranging from 0 to 20000 g/m$^2$ and higher. Method 2 is based in part on the discovery that for a wide range of conductances and water weights, calibrating curves can also be consolidated into a single calibration curve using multiple adjustment parameters in a calibration equation. It has been observed that the relationship between the paper stock or solution conductance (SC) and the reference sensor resistance (or equivalently, the conductance) is linear. FIG. 9 is a graph of independent measurements of conductance vs. the inverse of saturated reference resistance for a paper stock.

The linear relationship can be expressed as Equation 3:

$$SC=(\Delta SC/\Delta G_{ref})*G_{ref}+SC_{Gref0} \tag{3}$$

where:

$\Delta SC/\Delta G_{ref}$ is the change in solution conductance with change in the reference sensor conductance;

$G_{ref}$ is the reference sensor conductance reading; and $SC_{Gre0}$ is the projected solution conductance at $G_{ref}=0$.

Similarly, for the measurement sensors, the relationship is linear for a particular water weight and can be expressed as Equation 4:

$$SC=(\Delta SC/\Delta G)*G+SC_{G0} \tag{4}$$

where: $\Delta SC/\Delta G$ and G refer to similar readings for the measurement sensor; and $SC_{G0}$(is the projected solution conductance at G=0.

Figure 10:
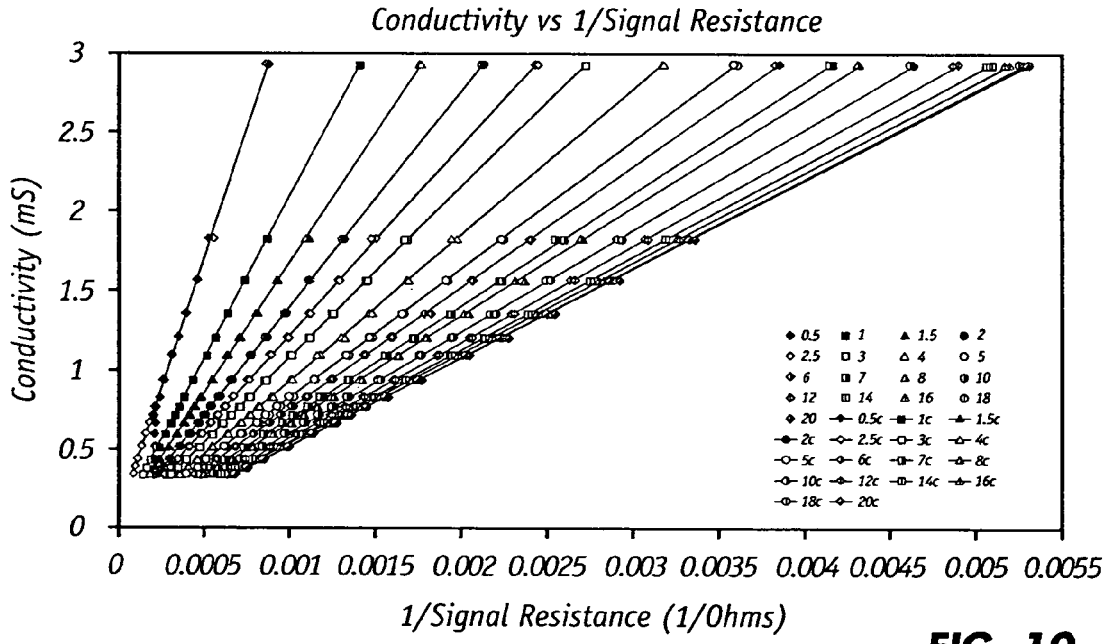
FIG. 10 is a graph of conductivity vs. 1/(signal resistance)

The relationship between conductance and the inverse of measurement sensor signal resistance is plotted in FIG. 10 for a large range of paper stock water weights.

Figure 11:
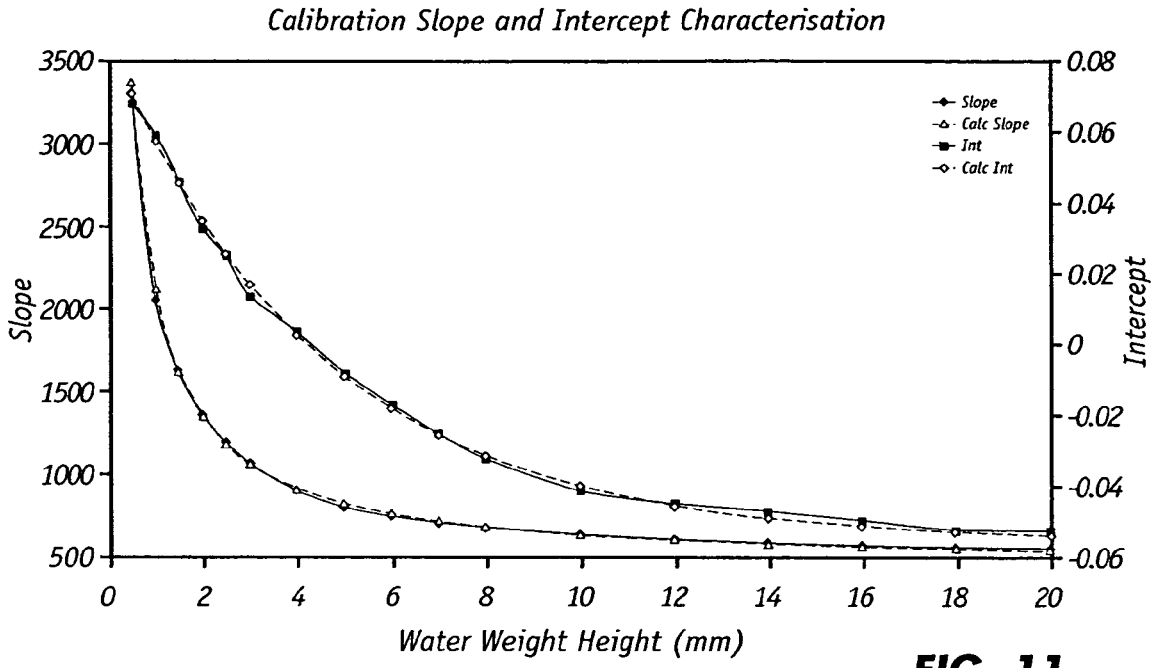
FIG. 11 is a graph of water weight height vs. slope and of water weight height vs. intercept.

$\Delta SC/\Delta G$ and $SC_{G0}$ can be plotted against water weight height as shown in FIG. 11. $\Delta SC/\Delta G$ is linear versus (1/water weight height) for any given water weight and can be expressed as Equation 5:

$$\Delta SC/\Delta G=\{\text{Slope}(\Delta SC/\Delta G)/(WWH+WWH_{offset})\}+(\Delta SC/\Delta G)_0 \tag{5}$$

where: Slope($\Delta SC/\Delta G$) is the slope of the line {i.e. change in $\Delta SC/\Delta G$ with (WWH+$WWH_{offset}$)};

WWH is the water weight height;

$WWH_{offset}$ is the water weight height offset; and $(\Delta SC/\Delta G)_0$ is the projected $\Delta SC/\Delta G$ at 1/(WWH+$WWH_{offset}$)=0

The projected conductance at any given water weight, $SC_{G0}$ can be expressed as Equation 6:

$$SC_{G0}=\{(A*\exp('WWH/\text{height}_{R0})\}+\text{Offset} \tag{6}$$

where: the pre-exponential A, and the "Offset" term are fitting parameters; and $\text{height}_{R0}$ is a normalizing constant.

$\Delta SC/\Delta G$ from Equation 4 can be substituted in Equation 5 to yield Equation 7:

$$WWH=\text{Slope}(\Delta SC/\Delta G)/\{(SC-SC_{C0})/G-(\Delta SC/\Delta G)_0\}-WWH_{offset} \tag{7}$$

With these relationships, the water weight can be determined from conductance measurements from a reference sensor and a measurement sensor using the following iterative method:

1. Calculate SC from the reference sensor conductance, $G_{ref}$, using Equation 3.
2. Applying Equation 5 to the data in FIG. 11 yields:
   a. Slope($\Delta SC/\Delta G$)=1952
   b. $(\Delta SC/\Delta G)_0$=451 ohms
   c. $WWH_{offset}$=0.17 mm
3. Assuming $SC_{G0}$=0 for the first iteration, substituting the measured G, SC into Equation 7 yields an initial WWH
4. Use the initial WWH in Equation 6 to calculate $SC_{G0}$.
5. Use the calculated $SC_{G0}$ to calculate a final WWH with Equation 7.

Papermaking Machine Process Control

Water weight sensors (or an array arranged in the MD and/or CD underneath the wire) can be employed to optimize papermaking machines. Process control techniques for papermaking machines are further described, for instance, in U.S. Pat. No. 6,149,770 to Hu et al., U.S. Pat. No. 6,092,003 to Hagart-Alexander et. al, U.S. Pat. No. 6,080,278 to Heaven et al., U.S. Pat. No. 6,059,931 to Hu et al., U.S. Pat. No. 6,853,543 to Hu et al., and U.S. Pat. No. 5,892,679 to He, which are all incorporated herein by reference.

Figure 12:
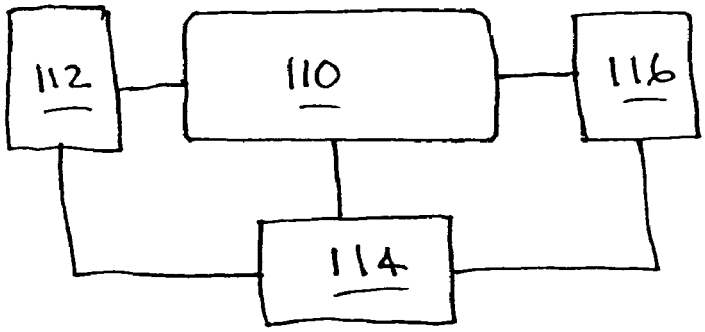
FIG. 12 is schematic of a process control system.

As is apparent, a number of parameters of the wet end and dry end of the papermaking machine as illustrated in FIGS. 1A and 1B can be regulated. FIG. 12 depicts a papermaking machine 110 having a wet end 112 and a dry end 116. Control unit 114 that includes a computer receives readings from measurement and reference water weight sensors from machine 110. The conductance readings are converted to water weight measurements with the mathematical relationships developed using the calibration techniques. In the case where an MD array of sensors is employed, a continuous water weight profile of the paper stock on the web can be generated and compared to an "ideal" profile for making a particular grade of paper. Depending on the degree of deviation from ideal, wet end and/or dry end parameters can be adjusted accordingly. See, for example, U.S. Pat. No. 6,092,003 to Hagart-Alexander which is incorporated herein. While dry end parameters, e.g., temperature of heating devices, can be controlled to achieve the desired final product, typically the wet end parameters are more important and will be further described herein.

A wide range of chemicals is utilized in the papermaking stock furnish to impart or enhance specific sheet properties or to serve other necessary purposes. Such additives as alum, sizing agents, mineral fillers, starches and dyes are commonly used. Chemicals for control purposes such as drainage aids, defoamers, retention aids, pitch dispersants, slimicides, and corrosion inhibitors are added as required. Fabrication of quality paper required addition of the proper amount of these chemicals.

Wet end chemistry deals with all the interactions between furnish materials and the chemical/physical processes occurring at the wet end of the papermaking machine. The major interactions at the molecular and colloidal level are surface charge, flocculation, coagulation, hydrolysis, time-dependent chemical reactions and microbiological activity. These interactions are fundamental to the papermaking process. For example, to achieve effective retention, drainage, sheet formation, and sheet properties, it is necessary that the filler particles, fiber fines, size and starch be flocculated and/or adsorbed onto the large fibers with minimal flocculation between the large fibers themselves.

Control of wet-end chemistry is vital to ensure that a uniform paper product is manufactured. The wet end of a papermaking machine is also critical in determining the long-term stability of the machine and ultimately the quality of the resulting product. Wet end control is further described in U.S. Pat. No. 6,1166,839 to Heaven et al. and U.S. Pat. No. 6,086,716 to Watson et al., which are both incorporated herein.

Typically, the papermaking furnish or raw material is metered, diluted, mixed with any necessary additives, and finally screened and cleaned as it is introduced into headbox from a fan pump. Any of these unit operations can be regulated. For example, paper stock is supplied to a machine chest from a refiner which includes adjustable mechanical elements, e.g., motorized disk elements or plates to grind the paper fiber surfaces. Generally, the refiner is part of the stock preparation system which prepares, conditions, and/or treats the pulp or stock in such a manner that a satisfactory sheet of paper can be produced. Adjusting the load will increase or decrease the degree of mechanical action on the pulp by the mechanical elements in the refiner. The refiner is connected to sources of thick stock and water. For high quality paper typically more than one source of pulp is used. Vigorously grinding the paper stock in the refiner reduces the rate at which water will drain through the wire mesh. Thus, it is common to refer to a rapidly draining stock as being "free", or having high freeness, whereas more highly grinded stock is referred to as being slow, or having low freeness. In addition, wet end control also includes means for adding non-fibrous additives to the papermaking stock described above. Chemical additives are added at different steps in the process.

The water drainage profile on a fourdrinier wire is a complicated function principally dependent on the arrangement and performance of drainage elements, characteristics of the wire, tension on the wire, stock characteristics (for example freeness, pH and additives), stock thickness, stock temperature, stock consistency wire speed and refiner load or power. By controlling one or more operating parameters of the system the quality of the paper fabricated can be regulated. Although one may adjust the concentration of additives to regulate the final product, and/or regulate the flow of pulp into the refiner when more than one source is employed, generally for a particular grade of paper, it is preferred to maintain the concentration of the additives and pulp flow rates once the optimum levels are set.

In one embodiment of the control system, one or more of the other process parameters while keeping the flow of additives and pulp within certain set points. One such parameter is the refiner power. This can be accomplished by using a refiner that has a refiner plate position control system. By subjecting fibers to different levels of mechanical action, the paper stock flowing onto the wire will exhibit different properties, e.g., drainage characteristics.

Finally, the ratio of jet velocity of the paper stock through the slice of headbox to wire velocity is usually adjusted near unity to achieve best sheet formation. Typically, this ratio is maintained between 0.95 to 1.05 but usually it is not maintained at exactly 1. If the jet velocity lags the wire, the sheet is said to be "dragged"; if the jet velocity exceeds the wire speed, the sheet is said to be "rushed". Sometimes, it is necessary to rush or drag the sheet slightly to improve drainage or change fiber orientation. The jet speed is not actually measured, but is inferred from the headbox pressure. The jet-to-wire ratio can be changed by adjusting the wire speed or the jet speed. The wire speed is typically adjusted by changing the speed of the large rolls at the beginning and end of the wire which the wire travels on. Often times the couch roll, i.e., the end roll, controls the speed of the wire. The jet speed is adjusted by the headbox pressure.

Water Weight Sensors

Suitable sensing devices for use in the present invention include water weight sensors which are available under the trade name SPECTRAFOIL from Honeywell, Inc. and which are described in U.S. Pat. No. 5,954,923 to Chase et al., which is incorporated herein. These sensors have a very fast response time (1 msec) so that an essentially instantaneous water weight can be obtained. The SPECTRAFOIL brand sensors are positioned underneath the wire of a papermaking machine, e.g., fourdrinier. The invention will be described with the water weight sensors having the construction illustrated herein but it is understood that other water weight sensors having similar characteristics can be employed.

Figure 2:
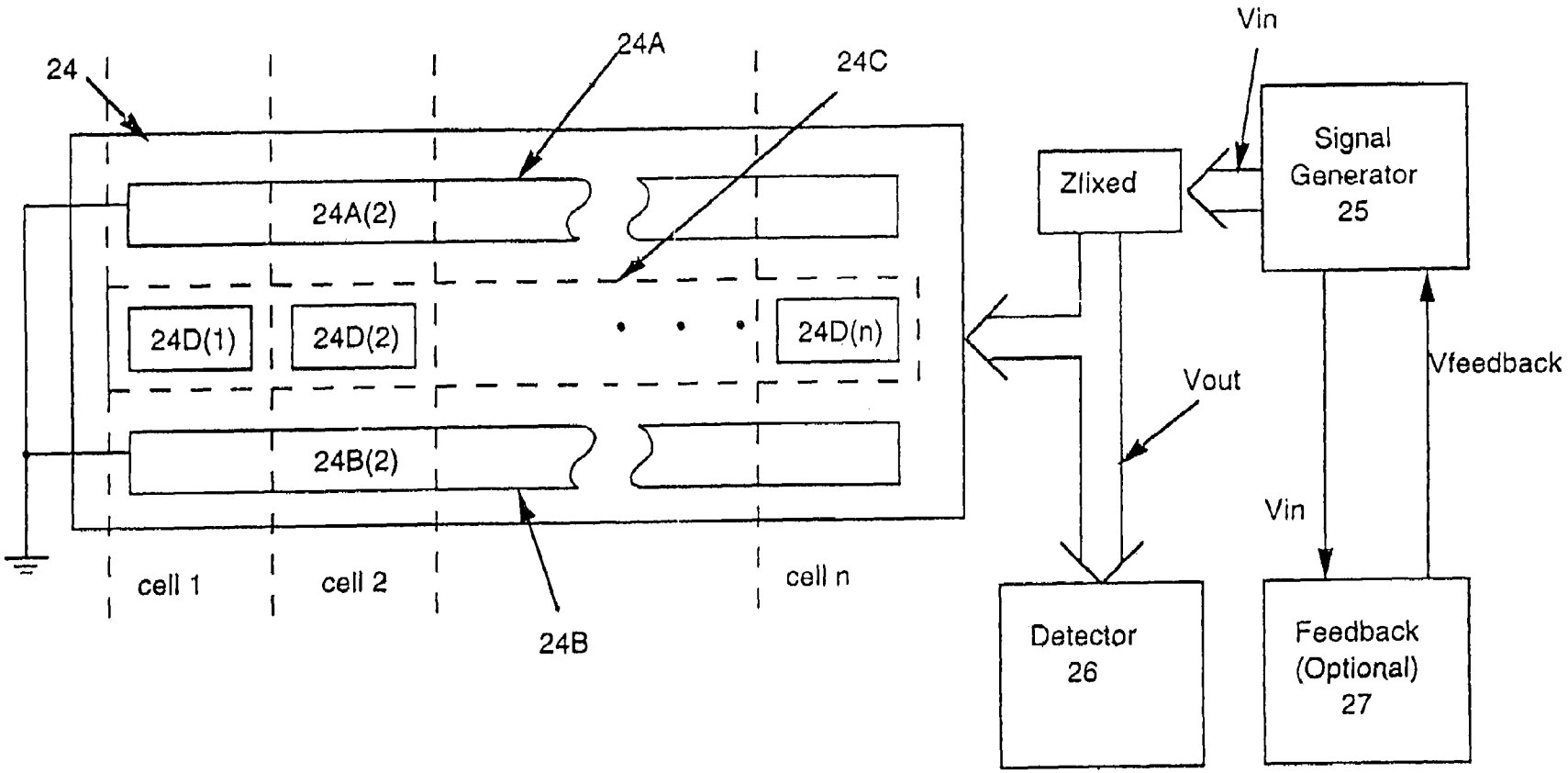
FIGS. 2 and 3 show the measurement apparatus and its electrical representation, respectively.

FIG. 2 shows the basic configuration of a water weight sensor that includes a sensor array with two elongated grounded electrodes 24A and 24B and a segmented electrode 24C. Measurement cells (cell 1, cell 2, . . . cell n) each includes a segment of electrode 24C and a corresponding portion of the grounded electrodes (24A and 24B) opposite the segment. Each cell detects a resistance of the wet stock and specifically the water portion of the stock residing in the space between the segment and its corresponding opposing portions of grounded electrode. Each cell is independently coupled to an input measurement voltage (Vin) from signal generator 25 through an impedance element Zfixed and each provides an output voltage to voltage detector 26 on bus Vout. Signal generator 25 provides Vin. Device 26 includes circuitry for detecting variations in voltage from each of the segments in electrodes 24C and any conversion circuitry for converting the voltage variations into useful information relating to the physical characteristics of the aqueous mixture.

Figure 3:
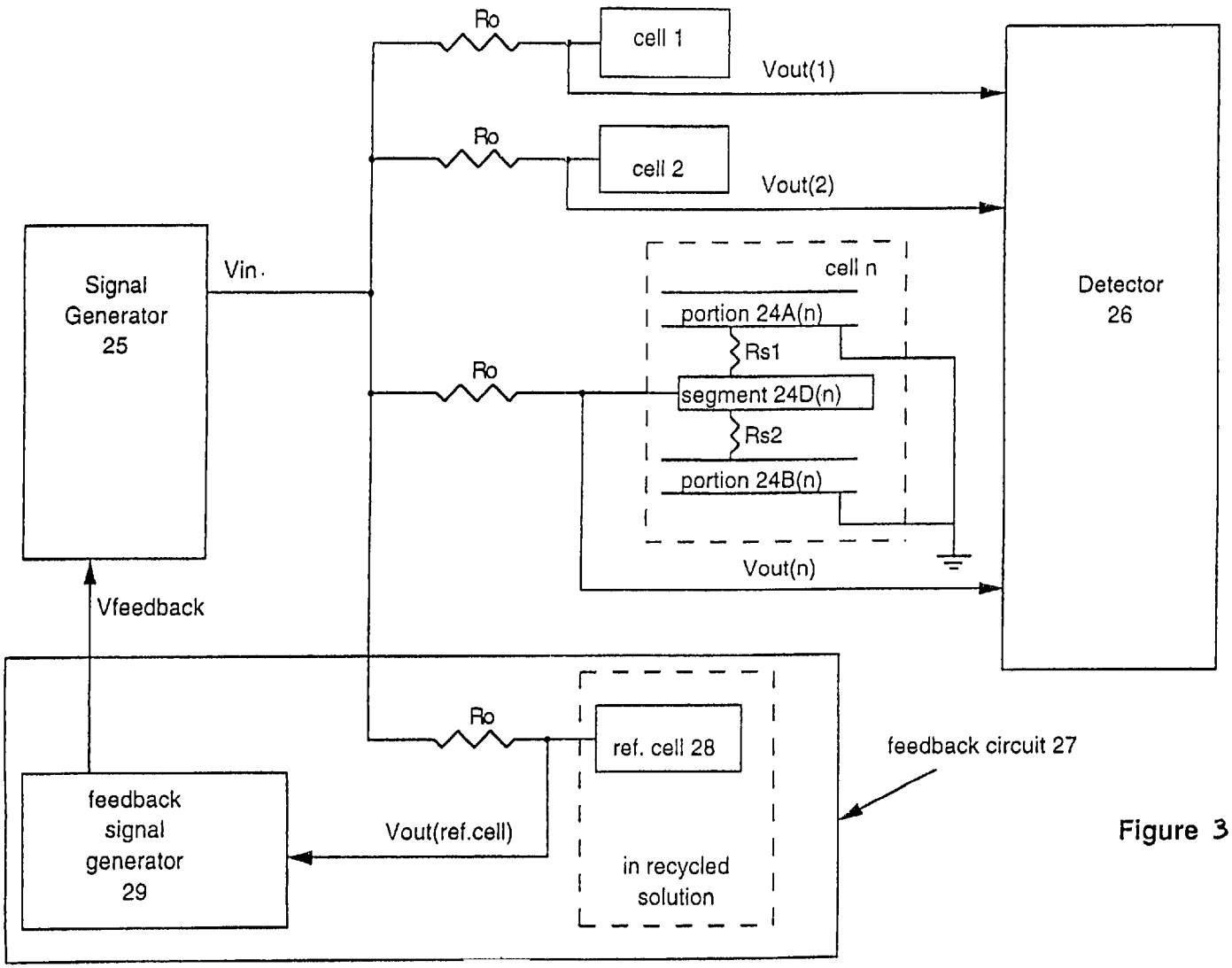

FIG. 3 illustrates an electrical representation of the measuring apparatus shown in FIG. 2 including cells 1–n of sensor array 24 for measuring conductivity of an aqueous mixture. As shown, each cell is coupled to Vin from signal generator 25 through an impedance element which, in this embodiment, is resistive element Ro. Referring to cell n, resistor Ro is coupled to center segment 24D(n) and portions 24A(n) and 24B(n) (opposite segment 24D(n)) are coupled to ground. Also shown in FIG. 3 are resistors Rs1 and Rs2 which represent the resistance of the aqueous mixture between the segments and the grounded portions. Resistors Ro, Rs1, and Rs2 form a voltage divider network between Vin and ground. It should be understood that the apparatus shown in FIGS. 2 and 3 can be implemented with a single grounded electrode which is adjacent and positioned opposite to a single segmented electrode.

Resistances Rs1 and Rs2 are dependent on changes in the water depth and the bulk conductivity of the aqueous mixture. The bulk conductivity of the mixture in turn is influenced by a number of factors, including, for example, mixture temperature, chemical additions, the concentration of fiber. When using the measurement apparatus to measure only water weight, it is necessary to cancel out the affects of the bulk conductivity seen in the detected resistance between the electrodes. This is done with a feedback apparatus 27, as shown in FIGS. 2 and 3, which generates a feedback signal to adjust Vin to compensate for changes in bulk conductivity.

The feedback circuit 27 including reference cell 28 and feedback signal generator 29. The concept of the feedback circuit 27 is to isolate a reference cell such that it is affected by aqueous mixture physical characteristic changes other than the physical characteristic that is desired to be sensed by the system. For instance, if weight is desired to be sensed then the weight is kept constant so that any voltage changes generated by the reference cell are due to physical characteristics other than weight changes. In one embodiment, reference cell 28 is immersed in an aqueous mixture of recycled water which has the same chemical and temperature characteristics of the water in which cell array 24 is immersed in. Hence, any chemical or temperature changes affecting conductivity experienced by array 24 is also sensed by reference cell 28. Furthermore, reference cell 28 is configured such that the weight of the water is held constant. As a result voltage changes Vout (ref. cell) generated by the reference cell 28 are due to changes in the conductivity of the aqueous mixture, not the weight. Feedback signal generator 29 converts the undesirable voltage changes produced from the reference cell into a feedback signal that either increases or decreases Vin and thereby cancels out the affect of erroneous voltage changes on the sensing system. For instance, if the conductivity of the aqueous mixture in the array increases due to a temperature increase, then Vout (ref. cell) will decrease causing a corresponding increase in the feedback signal. Increasing Vfeedback increases Vin which, in turn, compensates for the initial increase in conductivity of the aqueous mixture due to the temperature change. As a result, Vout from the cells only change when the weight of the aqueous mixture changes.

Figure 4A:
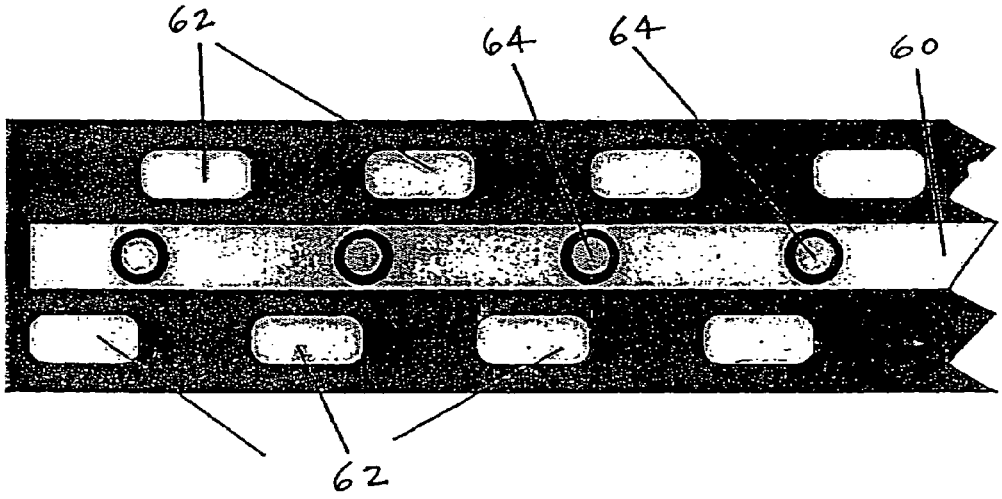
FIG. 4A shows the top plan view of an electrode configuration having reference cells built into the measurement electrode configuration.

Instead of using an external reference cell and feedback circuit, the electrode configuration can include a built-in reference cell within the measurement electrode configuration. FIG. 4A shows a measurement electrode configuration having a first center elongated grounded electrode or rail 60 with second and third segmented measurement electrodes 62 on either side of grounded electrode 60. As with the measurement apparatus shown in FIGS. 2 and 3, each measurement electrode segment is coupled to an impedance element (not shown) which, in turn, is coupled to a measurement input signal. For instance, each measurement electrode segment 60 is coupled to a resistor Ro (as shown in FIG. 3) which is coupled to Vin. An output voltage signal Vout is taken from each electrode segment which corresponds to a detected measurement electrode resistance ($R_{measured}$) of the mixture between each electrode segment and ground.

The electrode configuration further includes a plurality of interspaced reference electrodes 64 built into grounded electrode 60. A circular layer of dielectric insulates each reference electrode from the elongated grounded center electrode. The reference electrodes form an array of reference cells each including a reference electrode and the portion of the grounded electrode surrounding the reference electrode. As is with the measurement electrodes, each reference electrode is coupled to an impedance element and a measurement input signal Vin in order to measure the reference electrode resistance ($R_{ref}$) of the aqueous mixture between the reference electrode and ground formed by the circle of dielectric material encircling the reference electrode. In another embodiment, more than one reference electrode can be associated with a single measurement electrode segment. In still another embodiment, a single segmented electrode can be used instead of two on either side of the ground electrode, wherein the measurement electrode configuration only includes one elongated, segmented electrode and an elongated, grounded electrode.

Figure 4B:
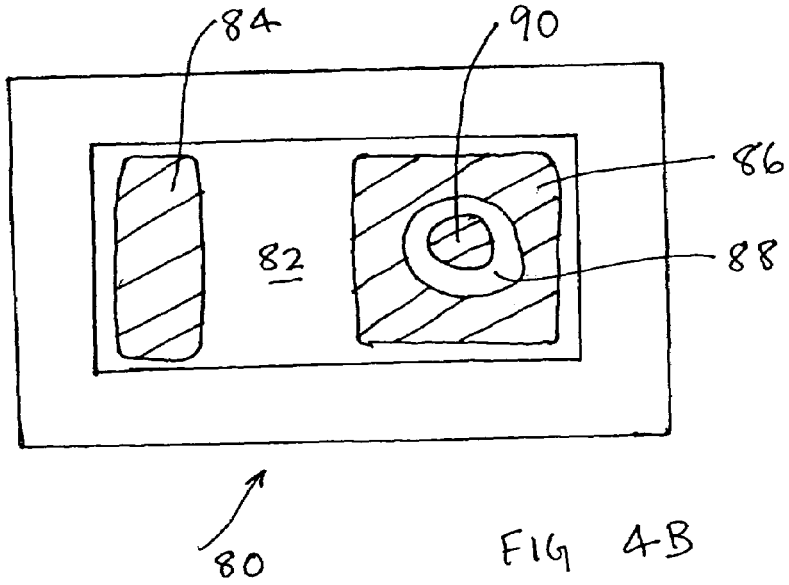
FIG. 4B shows the top view of a sensor that is embedded in a foil.

FIG. 4B illustrates an alternative embodiment of a sensor 80 that is embedded in a ceramic foil or support 92 that can be positioned under the web of a papermaking machine. The sensor 80 includes a center reference electrode 90, outer ground electrode 86, and measurement electrode 84 which are insulated by dielectric materials 82 and 88.

The measurement and reference electrodes can be constructed so that they exhibit different sensitivities to a first property but exhibit relatively the same sensitivity to a second property. For instance, both the reference and measurement electrodes can have the same sensitivity to changes in bulk conductivity on the wet stock but have different sensitivities to changes in water depth. In particular, if the bulk conductivity of the wet stock changes, each of the reference and measurement electrodes detects a similar change in resistance, when the water depth is kept constant. However, the reference and measurement electrodes have different sensitivities to changes in water depth. As a result, for the same depth of the aqueous mixture, each of the reference and measurement electrodes will detect a different resistance.

The sensitivity of either a reference or measurement electrode cell to the depth of water depends on the spacing between the grounded electrode and the electrode opposite the grounded electrode which is coupled to the impedance element. For instance, the spacing between one of the measurement electrode segments and the grounded elongated electrode determines the sensitivity of that measurement cell. Similarly, the spacing of the dielectric which encircles the reference electrode between one of the reference electrodes and the grounded elongated electrode determines the sensitivity of the reference cell to water depth.

When the sensitivity of the reference electrodes to changes in water depth is made sufficiently low, then its output will be dominated by changes in the intrinsic bulk conductivity of the liquid. Its output then can be utilized to compensate for the effects of changes in the intrinsic bulk conductivity of the liquid on the measurement electrode output. The resistance, or its reciprocal the conductance, measured by the sensor is the sum of the contribution due to the intrinsic bulk conductivity of the liquid and of the contribution due to the water weight or depth. This behavior can thus be described in a single equation. It is not necessary that both the measurement and reference electrodes have a different sensitivity to a first property but have relatively the same sensitivity to a second property. Alternatively, the measurement and reference electrodes are constructed so that they have different sensitivities to both the first and second properties.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A method of monitoring the formation of a sheet of wet stock comprising fibers wherein the wet stock is formed on a water permeable movable wire of a de-watering machine that has a headbox with a plurality of apertures through which wet stock is introduced onto the wire at a controlled flow rate, said method comprising the steps of:

(a) positioning three or more water weight sensors (measurement sensors) underneath and adjacent to the wire and upstream from a dry line which develops during operation of the machine wherein the measurement sensors all have substantially the same configuration;

(b) positioning a reference sensor so that it will measure the wet stock under saturated conditions;

(c) calibrating the measurement sensors to equate conductance measurements made by the three or more water weight sensors to water weight above the three or more water weight sensors to develop a calibration equation, wherein step (c) comprises of (i) measuring conductance of the wet stock with a conductance detector while simultaneously recording reference sensor readings over a range of wet stock conductances to calibrate the reference sensor;

(ii) measuring a range of water weights with a range of wet stock conductances using the measurement sensors to characterize their responses;

(iii) developing a universal calibration relationship between wet stock conductivity and conductance measured by the measurement sensors over a range of water weight samples using data produced in steps (i) and (ii); and (iv) developing a universal calibration equation that provides a water weight as a function of wet stock conductivity, measured conductance, and relationship between the wet stock conductivities and measured conductances for the reference sensor and the measurement sensors, and following step (c);

(d) measuring the conductance of the wet stock with one or more of the measurement sensors and using the calibration equation to provide the absolute water weight(s) in substantially real time.

2. The method of claim 1 wherein:

step (a) comprises placing the three or more measurement sensors (measurement sensors) at different locations in tandem along the direction of movement of the wire; and step (b) comprises positioning the reference sensor underneath and adjacent to the wire and in the vicinity of apertures of the headbox.

3. The method of claim 1 wherein the three or more water weight sensors are positioned substantially in tandem along the machine direction underneath the wire.

4. The method of claim 1 wherein the de-watering machine includes:

wet-dry devices that comprises (i) means for supplying an amount of pulp from at least one source, (ii) means for adding an amount of non-fibrous additives to the wet stock, (iii) a refiner that subjects the fibers to mechanical action, said refiner having a motor load controller, and (iv) a headbox having at least one slice wherein each slice has an aperture through which wet stock is discharged at a certain stock jet speed onto the wire that is moving at a certain wire speed.

5. The method of claim 4 further comprising adjusting at least one of the stock jet speed, wire speed, or motor load controller to cause a water weight profile to match a preselected water weight profile.

6. The method of claim 4 further comprising adjusting at least one of the stock jet speed or wire speed and maintaining the ratio of stock jet speed to wire speed between about 0.95 to 1.05 provided that the ratio is not maintained at exactly 1.

7. The method of claim 4 wherein the headbox has actuators that control the discharge of wet stock through a plurality of slices and the method further comprises adjusting the jet speed by regulating the discharge of wet stock through the slices in response to absolute water weight measurements.

8. The method of claim 4 wherein the headbox comprises a chamber containing wet stock that is maintained at a pressure level and the method further comprises adjusting the jet speed by regulating said pressure in response to absolute water measurements.

9. The method of claim 4 wherein the wet stock is paper stock.

10. The method of claim 4 further comprising adjusting at least one of the motor load controller, the amount of non-fibrous additives added to the wet stock, or the amount of pulp supplied from at least one source in response to absolute water weight measurements.

11. A system of controlling the formation of wet stock which comprises fibers on a moving water permeable wire of a de-watering machine that includes:

wet-dry devices that comprises (i) means for supplying an amount of pulp from at least one source, (ii) means for adding an amount of non-fibrous additives to the wet stock, (iii) a refiner that subjects the fibers to mechanical action, said refiner having a motor load controller, and (iv) a headbox having at least one slice wherein each slice has an aperture through which wet stock is discharged at a certain stock jet speed onto the wire that is moving at a certain wire speed, and dry-end devices that dry a sheet of material from the wire, which system comprises:

(a) at least three water weight measurement sensors that are positioned adjacent to the wire and upstream from a dry line which develops during operation of the machine;

(b) a reference sensor that measures the water weight or the wet stock under saturated conditions, wherein the measurement sensors have been calibrated to equate conductance measurements made by the measurement sensors to water weight above the measurement sensors by:

(i) measuring conductance of the wet stock with a conductance detector while simultaneously recording reference sensor readings over a range of wet stock conductances to calibrate the reference sensor;

(ii) measuring a range of water weights with a range of wet stock conductances using the measurement sensors to characterize their responses;

(iii) developing a universal calibration relationship between wet stock conductivity and conductance measured by the measurement sensors over a range of water weight samples using data produced in steps (i) and (ii); and (iv) developing a universal calibration equation that provides a water weight as a function of wet stock conductivity, measured conductance, and relationship between the wet stock conductivities and measured conductances for the reference sensor and the measurement sensors; and (c) means for adjusting at least one of the wet-end or dry-end devices in response to water weight measurements.

12. The system of claim 11 comprising means for adjusting at least one of the stock jet speed, wire speed, or motor load controller to cause a water weight profile to match a preselected water weight profile.

13. The system of claim 11 comprising means for adjusting at least one of the stock jet speed or wire speed, and comprising means for measuring the stock jet speed and the wire speed ratio and maintaining this ratio between about 0.95 to 1.05 provided that the ratio is not maintained at exactly 1.

14. The system of claim 11 wherein said means for adjusting at least one of the stock jet speed or the wire speed regulates the stock jet speed.

15. The system of claim 11 wherein the headbox has actuators that control the discharge of wet stock through a plurality of slices and wherein the means for regulating jet speed regulates the discharge of wet stock through the slices.

16. The system of claim 11 wherein the headbox comprises a chamber containing wet stock that is maintained at a pressure level and the means for regulating the jet speed regulates said pressure.

17. The system of claim 11 wherein at least three measurement water weight sensors are positioned substantially in tandem along the machine direction underneath the wire.

18. The system of claim 11 wherein the wet stock is paper stock.

19. The system of claim 11 comprising means for adjusting at least one of the motor load controller, the amount of non-fibrous additives added to the wet stock, or the amount of pulp supplied from at least one source in response to water weight measurements.

20. The system of claim 19 wherein the amount of non-fibrous additives added to the wet stock is maintained within a preselected range.

* * * * *